United States Patent [19]

Dassler

[11] 4,069,598

[45] Jan. 24, 1978

[54] SPORT SHOE

[76] Inventor: Armin A. Dassler, Ringstrasse 121, D-8522 Herzogenaurach, Germany

[21] Appl. No.: 725,670

[22] Filed: Sept. 22, 1976

[30] Foreign Application Priority Data

Sept. 25, 1975 Germany ..... 2542760

[51] Int. Cl.[2] ..... A43B 5/00; A43B 13/28

[52] U.S. Cl. ..... 36/114; 36/12

[58] Field of Search ..... 36/83, 114, 4, 32 R, 36/25 R, 12, 14, 22 R, 23; 12/142 R, 142 D, 142 E, 146 D

[56] References Cited

U.S. PATENT DOCUMENTS

| | | | |
|---|---|---|---|
| 3,029,823 | 4/1962 | Zerkowitz | 36/4 |
| 3,145,487 | 8/1964 | Cronin | 12/142 R |
| 3,555,706 | 1/1971 | Edmonds | 36/114 |

*Primary Examiner*—Patrick D. Lawson

*Attorney, Agent, or Firm*—Nims, Howes, Collison & Isner

[57] ABSTRACT

A sport shoe construction of the type where a shell edge band peripherally overlies at least a portion of the marginal edge of the shoe outersole and the adjacent marginal edge portion of the upper shaft material, the incorporation of a plurality of mechanical gripping members operatively embedded in said upper shaft material and the interfacially abutting portion of said shell edge selectively positioned to mechanically restrain downward movement of said shell edge relative to the interfacially abutting portions of the shaft material.

16 Claims, 6 Drawing Figures

SPORT SHOE

Figure 1:
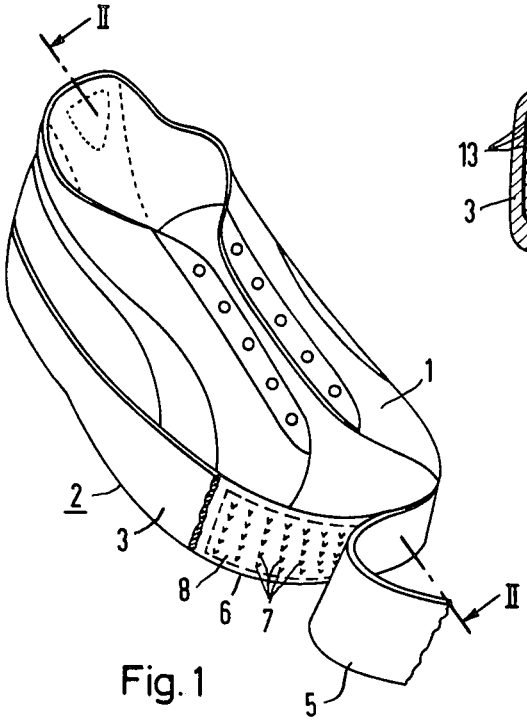

The invention relates to a sports shoe, particularly, a tennis shoe with an outsole constructed as a shell sole.

Outsoles constructed as shell soles have an all-round raised edge which is attached by adhesion to the shaft material. To produce a permanent and firm adhesive joint, it is necessary that that part of the shoe shaft embraced by the shell edge of the shell sole is sufficiently roughened. Roughening must take place very carefully because roughening of the shoe shaft above the shell sole edge makes the shoe unattractive, whilst if the shoe shaft is not roughened right down to the shell sole or the upper adhesive edge of the shell sole, no permanent adhesive joint can be obtained. Especially in the particularly stressed areas of the toe and ball of the shoe, there is a danger that the edge of the shell sole will burst open after a short time making the sports shoe unusable.

The problem of the invention is to so construct a sports shoe, particularly a tennis shoe of the type defined hereinbefore that it does not have the above-described disadvantages. In particular, it is intended that it shall no longer be necessary to roughen the shaft material in the especially stressed sole areas, specifically the toe of the shoe and optionally also the ball area precisely up to the upper adhesive edge of the shell sole.

According to the invention, this problem is solved in that at least in the area of the toe of the shoe, and preferably also in the ball area, a plurality of gripping members are provided which pass through the shaft material and engage in the edge of the shell shoe and/or pass through the edge of the shell shoe and engage in the shaft material. On pulling the shell sole onto the shoe shaft, the ends of the gripping members partly engage in the shaft material when the said gripping members are arranged in the shell sole edge or when they are arranged in the shaft material, they partly engage in the shell sole edge, so that in addition to the conventional adhesive joint, an additional positive connection which effectively aids the adhesiveness thereof is provided. The strength of the positive connection between the exposed ends of the gripping members and the shaft material and/or the shell sole edge is so large that in the toe area of the shoe, the adhesive joint is reliably protected from excessive stresses.

This action is particularly pronounced if, according to further developments of the invention, when arranging the supporting member for the gripping members in the outsole or in the shell edge thereof, the gripping members are inclined somewhat downwardly relative to the shell sole tread or when the supporting member for the gripping members is arranged in or on the shaft material, the gripping members are inclined somewhat upwardly with reference to the shell sole tread. In this case, the ends of the gripping members grip like barbs in the adjacent shaft or sole material, so that even without additional adhesion in the area of the toe of the shoe and optionally also the ball thereof, an unintentional detachment of the shell sole edge is no longer possible. An additional adhesive joint is, however, generally provided at these points on the outsole in order for optical reasons alone to prevent an opening of the shell sole edge.

Further details and advantages of the invention can be gathered from the following embodiments with reference to the drawings, wherein show:

FIG. 1 a schematic perspective view of a tennis shoe according to the invention.

Figure 2:
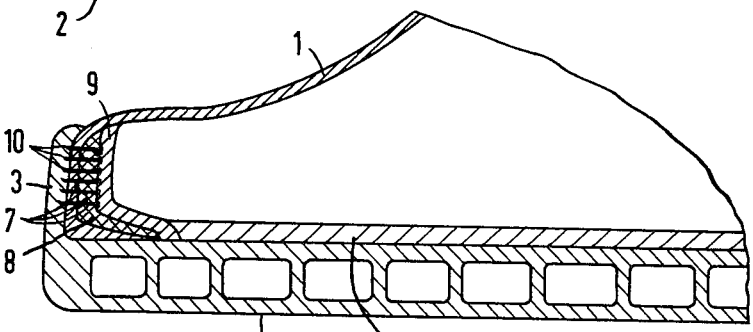

FIG. 2 a section through the tennis shoe according to FIG. 1 along the sectional plane II—II of FIG. 1.

Figure 3:
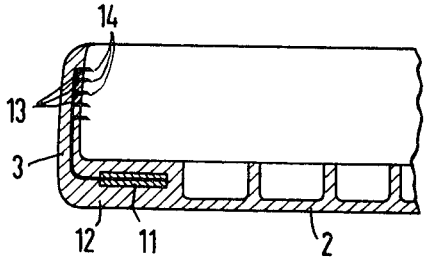

FIG. 3 a partial section through a shell sole with a supporting member and gripping members embedded therein.

Figure 4:
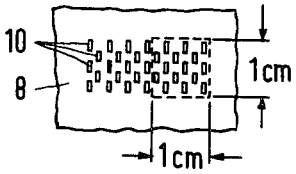

FIG. 4 a plan view onto part of the supporting member for the gripping members, as is provided with the embodiment of FIG. 2.

Figure 5:
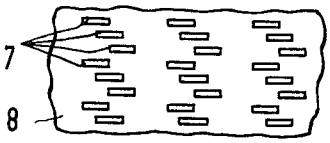

FIG. 5 a rear view of part of the supporting member for the gripping members according to FIG. 4.

Figure 6:
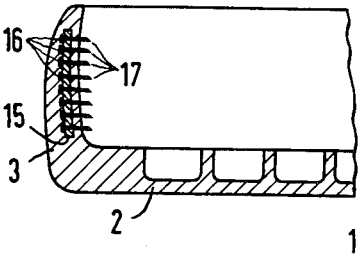

FIG. 6 a partial section through a further embodiment of a shell sole with a supporting member and gripping members embedded therein.

The tennis shoe shown in FIG. 1 is substantially comprised of a shaft 1 made from conventional shaft material, such as leather or fibrous tissue, particularly natural or synthetic fibrous tissue, a shell sole or outsole 2, constructed as a grooved sole, with an all-round shell edge 3 as well as a conventional welt 4 (FIG. 2) and a cover shoe not shown in the drawings. In the perspective view according to FIG. 1, part 5 of the shell edge 3 is broken open in order to show the gripping members 7 arranged in the area of the toe 6 of the shoe in shaft material 1 and/or in the shell sole 2 or in the shell edge 3.

In the embodiment shown in FIGS. 1 and 2, the gripping members 7 are mounted in a supporting member 8, preferably a supporting plate. The supporting member 8 made from a flexible material can be adapted without a great resistance to the shape of the shaft material 1 or the shell sole 2 in the area of toe 6. The supporting member 8 can be made from leather, fabric, rubber or rubber-like plastic and after passing, particularly pressing the gripping member 7 through the shaft material 1, it is bonded with the latter. Towards the inside of the shoe, a soft inner cap 9 can be stuck to the supporting member 8 and covers the mounting points of gripping members 7. The wall thicknesses of supporting member 8 and inner cap 9, as well as the thickness of gripping members 7 are slightly exaggerated to increase the clarity of representation.

As shown in FIGS. 1 and 4, the gripping members 7 are closely juxtaposed and superimposed in supporting member 8, so that they form a gripping member block or a gripping member cushion. The density of the gripping members 7 is preferably 10 to 15 members/cm$^2$ (FIG. 4). Obviously, a lower density of gripping members can be used in the case of less stressed sports shoes such as leisure shoes, with a higher density in the case of very highly stressed sports shoes such as tennis shoes. With reference to the tread of outsole 2, the gripping members 7 are inclined slightly upwards, whereby their exposed ends 10 passing through the shaft material 1 are inclined downwards, so that the ends 10 of gripping members 7 form sharp tips, which effectively hook with the elastic material of the shell edge 3 of shell sole 2.

The ends 10 of the gripping members 7 project from the shaft material 1 by between a few tenths of a millimeter and up to about 2 millimeters, depending on the thickness and material of the shell edge 3. As a result of the said upward inclination by about 5 to 20° in a plane parallel to the outsole surface, a barb effect occurs which makes impossible a subsequent detachment for removal of the shell sole 2 from the shaft 1.

The gripping member 7 can be constructed in the manner of thumbtacks with rear cover plates engaging with supporting member 8 or in the manner of stitching hooks, being fixed to the supporting member 8. In the area of the toe 6 of the shoe, the shaft material 1 can be provided with perforations to facilitate the passage therethrough of the gripping members 7. The gripping members 7 are preferably made from a corrosion-resisting material, such as stainless steel or plastic.

According to a further embodiment of the invention, the gripping member 7 and supporting member 8 can be embedded in the shell edge 3 or in the front sole area of the outsole when producing the shell sole 2 by the injection moulding process. If the gripping members 7 together with the supporting member 8 of the same are embedded in the shell edge 3 by pouring or injection, it is recommended that said members 7 and 8 are instructed in the manner described relative to FIG. 6.

However, it is also possible to construct the supporting member 8 as a narrow supporting strip 11 (FIG. 3), whereby it is embedded, in the manner described hereinbefore, in the front sole area 12 of outsole 2. In this embodiment, the gripping members 13 are preferably fixed to the lower side face or onto the rear end of supporting strip 11.

From there, they either extend through the supporting strip 11 or along the lower side face of supporting strip 11 into the shell edge 3 where, with their claw-like, inwardly bent and slightly downwardly inclined ends 14, they pass out of the shell edge 3 inwardly in the direction of the shaft 1 of the sports shoe. When pulling on the shell sole 2, a hooking process takes place, as described in conjunction with FIGS. 1 and 2. The bent legs of the gripping members 13 leading into the shell edge 3 can have different lengths so that a gripping member block or cushion can also be produced with this embodiment of the invention. According to a further embodiment, it is also possible to provide gripping members 13 with a plurality of hook or claw-like ends directed towards the inside of the foot.

As shown in FIG. 6, the plate-like supporting member 15 for the gripping member 16 can be embedded directly into the shell edge 3 of outsole 2 in the vicinity of the toe, whereby this preferably takes place by injecting or pouring. The gripping members 16 are inclined somewhat downwardly relative to the tread of outsole 2, whereby their exposed ends 17 passing through the shell edge 3 are inclined upwards. The ends 17 of gripping members 16 thus form sharp tips, which effectively hook with the shaft material 1 of the sports shoe. It is frequently sufficient if the ends 17 of the gripping members 16 project a few tenths of a millimeter out of the shell edge 3 in the direction of the inside of the shoe in order to ensure effective hooking with the shaft material. The downwards inclination of the gripping members 16 with reference to the tread of outsole 2 can, as described with reference to FIG. 2, preferably amount to about 5° to 20°.

In principle, an individual mounting of the gripping members in the shaft material and/or in the shell sole is possible. Such an embodiment will in particular be considered if the density of the gripping members to be provided per surface unit is comparatively small, in particular less than 5 members/cm$^2$. In the case of a relatively low gripping member density per surface unit, it is also possible to provide in each case one supporting member with gripping members both in or on the shaft material and also in the shell sole, whereby the gripping members must be staggered relative to one another.

To further increase the combined material and positive connection between shaft 1 and shell sole 2, a supporting member with gripping members can optionally also be provided in the ball and/or heel area of the outsole. It is also possible to make the supporting member with its gripping members located in the toe area so long that it extends up to the ball area of the outsole, and optionally also up to the heel area of the outsole. However, to reduce weight, the supporting member with its gripping members in the heel area, if in fact necessary, will generally be provided separately. However, an embodiment with a supporting member and a gripping member in the ball and heel area requires an outsole with pronounced rubberlike properties, in order to permit the drawing of the sole over the shoe shaft. However, in the case of such an embodiment, the engagement length of the gripping member ends can optionally be kept shorter. It is obvious that in connection with all the embodiments of the invention, the engagement length of the gripping member ends must be such that they adequately engage in the adjacent shaft material and/or in the shell sole material, but do not complete the passing through said parts.

The invention is not restricted to the use relative to tennis shoes. It can advantageously be used for all sports, particularly gymnasium sports where the shoes are highly stressed. However, the proposals according to the invention can be applied with particular advantage to fencing shoes and to shoes for playing handball.

What I claim is:

1. In a sport shoe, wherein shell edge means peripherally engirdle at least a portion of the marginal edge of the shoe outsole and at least a portion of the shaft material, the improvement comprising:

a plurality of discrete rod-like mechanical gripping members each having an end embedded in the shell edge means and each having a portion of the body of such gripping member within an abutting portion of the shaft material;

the rod-like gripping members being constructed, so that the body portions thereof located adjacent the ends of the gripping members opposite the ends embedded in the shell edge means are bent downwardly to form barb-like elememts for mechanically restraining downward movement of the shell edge means relative to the abutting portions of the shaft material.

2. A sport shoe as set forth in claim 1 wherein the shell means is integral with the shoe outsole.

3. A sport shoe as set forth in claim 1 including supporting means having the plurality of gripping members mounted thereon and being embedded within the shell edge means and wherein the rod-like gripping members are of a length sufficient to extend through the shell edge means and into the shaft material.

4. A sport shoe as set forth in claim 3 wherein the rod-like gripping members extend substantially through said shaft material.

5. A sport shoe as set forth in claim 3 wherein the ends of the rod-like gripping members opposite the ends embedded in the shell edge means are tapered to facilitate insertion thereof into the shaft material.

6. A sport shoe as set forth in claim 3 wherein the barb-like elements of the rod-like gripping members are selectively bent to permit insertion of the shell edge means on the shaft material with minimal downward displacement of the shell edge means relative to the interfacially abutting portions of the shaft material.

7. A sport shoe as set forth in claim 1 wherein at least 10 of the rod-like gripping members are disposed within a square centimeter of surface area of the shell edge means.

8. A sport shoe as set forth in claim 1 wherein the plurality of gripping members are located in the toe portion thereof.

9. In a sport shoe, wherein shell edge means peripherally engirdle at least a portion of the marginal edge of the shoe outsole and at least a portion of the shaft material, the improvement comprising:

a plurality of discrete rod-like mechanical gripping members each having an end embedded in the shell edge means and each having a portion of the body of such gripping member disposed within an abutting portion of the shaft material;

the rod-like gripping members being constructed so that the body portions thereof located adjacent the ends of the gripping members embedded in the shell edge means are bent upwardly to form barbed-like elements for mechanically restraining downward movement of the shell edge means relative to the abutting portions of the shaft material.

10. A sport shoe as set forth in claim 9 wherein the shell edge means is integral with the shoe outsole.

11. A sport shoe as set forth in claim 9 wherein at least 10 of the rod-like gripping members are disposed in a square centimeter of surface area of the shell edge means.

12. A sport shoe as set forth in claim 9 including supporting means located in abutting engagement with the shaft material on a side of the shaft material adjacent the shoe interior having the plurality of gripping members mounted thereon.

13. A sport shoe according to claim 12 wherein the ends of rod-like gripping members embedded in the shell edge means are tapered to facilitate insertion thereof into the shell edge means.

14. A sport shoe as set forth in claim 13 wherein the barb-like elements of the rod-like gripping members are selectively bent to permit insertion of the shell edge means on the shaft material with minimal downward displacement of the shell edge means relative of the abutting portion of the shaft material.

15. A sport shoe as set forth in claim 9 wherein the plurality of gripping members are located in the toe portion thereof.

16. In a tennis shoe, wherein shell edge means extending upwardly from and integral with the shoe outsole peripherally engirdle at least a portion of the adjacent marginal edge portion of the upper shaft material, the improvement comprising, a plurality of discrete rod-like mechanical gripping members having one end embedded in the portion of the shell edge means disposed at the toe of the shoe and the body portion of the gripping members disposed adjacent thereto operatively contained within the interfacially abutting portion of the shaft material;

the rod-like gripping members being angularly disposed so that the portions thereof located adjacent the shoe interior are lower in elevation than the end portions thereof embedded in said shell edge means for mechanically restraining downward movement of the shell edge means relative to the interfacially abutting portions of the shaft material.

* * * * *

UNITED STATES PATENT OFFICE

CERTIFICATE OF CORRECTION

Patent No. 4,069,598 Dated January 24, 1978

Inventor(s) Armin A. Dassler

It is certified that error appears in the above-identified patent and that said Letters Patent are hereby corrected as shown below:

In Claim 2, line 49, after "shell" insert -- edge --

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*